US010945090B1

(12) United States Patent
Choisel et al.

(10) Patent No.: US 10,945,090 B1
(45) Date of Patent: Mar. 9, 2021

(54) SURROUND SOUND RENDERING BASED ON ROOM ACOUSTICS

(71) Applicant: Apple Inc., Cupertino, CA (US)

(72) Inventors: Sylvain J. Choisel, Paris (FR); Brandon J. Rice, Pacifica, CA (US); Ismael H. Nawfal, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/828,836

(22) Filed: Mar. 24, 2020

(51) Int. Cl.

| | |
|---|---|
| ***H04S 7/00*** | (2006.01) |
| ***H04R 3/00*** | (2006.01) |
| ***H04R 1/40*** | (2006.01) |
| ***H04R 3/14*** | (2006.01) |
| ***H04R 5/02*** | (2006.01) |
| ***H04R 5/04*** | (2006.01) |
| ***H04S 3/00*** | (2006.01) |

(52) U.S. Cl.
CPC ..... *H04S 7/303* (2013.01); *H04R 1/403* (2013.01); *H04R 3/14* (2013.01); *H04R 5/02* (2013.01); *H04R 5/04* (2013.01); *H04S 3/008* (2013.01); *H04S 7/305* (2013.01); *H04S 2400/01* (2013.01); *H04S 2400/13* (2013.01); *H04S 2400/15* (2013.01); *H04S 2420/01* (2013.01)

(58) Field of Classification Search
CPC ..... H04R 1/403; H04R 1/406; H04R 3/00; H04R 3/04; H04R 3/12; H04R 3/14; H04R 5/00; H04R 5/02; H04R 5/04; H04R 29/00; H04R 29/001; H04R 29/002; H04S 7/00; H04S 7/30; H04S 7/303; H04S 7/305; H04S 7/307; H04S 3/08; H04S 2400/01; H04S 2400/13; H04S 2400/15; H04S 2420/01
See application file for complete search history.

(56) References Cited

U.S. PATENT DOCUMENTS 9,689,960 B1 * 6/2017 Barton ..... G01S 3/86
9,774,976 B1 * 9/2017 Baumgarte ..... H04S 7/302
(Continued)

FOREIGN PATENT DOCUMENTS

WO WO2014/151817 A1 9/2014

OTHER PUBLICATIONS

Unpublished U.S. Appl. No. 16/708,296 filed Dec. 9, 2019.

*Primary Examiner* — Thang V Tran
(74) *Attorney, Agent, or Firm* — Womble Bond Dickinson (US) LLP

(57) ABSTRACT

A method performed by an audio system within a room that includes a first loudspeaker that has a first beamforming array and a second loudspeaker that has a second beamforming array. The method obtains a sound program as several input audio channels. The method performs a beamforming algorithm based on the input audio channels to cause each of the arrays to produce a front beam pattern and a side beam pattern when the loudspeakers are close to an object within the room, where the front beam patterns are directed away from the object and the side beam patterns are directed towards the object and the beam patterns contain different portions of the sound program. The method performs a cross-talk cancellation (XTC) algorithm based on a subset of the input audio channels to produce several XTC output signals for driving the arrays when the loudspeakers are far away from the object.

20 Claims, 4 Drawing Sheets

(56) References Cited

U.S. PATENT DOCUMENTS

| | | | | |
|---|---|---|---|---|
| 2007/0230724 | A1* | 10/2007 | Konagai | H04R 3/12 381/303 |
| 2009/0123007 | A1* | 5/2009 | Katayama | H04S 7/302 381/300 |
| 2012/0020480 | A1* | 1/2012 | Visser | H04R 3/12 381/17 |
| 2012/0093344 | A1* | 4/2012 | Sun | H04R 3/005 381/122 |
| 2012/0213391 | A1* | 8/2012 | Usami | H04S 3/002 381/303 |
| 2015/0223002 | A1 | 8/2015 | Mehta et al. | |
| 2016/0012827 | A1* | 1/2016 | Alves | G10K 11/178 381/71.1 |
| 2016/0021480 | A1* | 1/2016 | Johnson | H04R 5/04 381/300 |
| 2017/0280265 | A1* | 9/2017 | Po | H04S 7/30 |
| 2018/0352325 | A1* | 12/2018 | Family | H03G 5/025 |
| 2018/0352331 | A1* | 12/2018 | Kriegel | H04R 3/12 |
| 2018/0352334 | A1* | 12/2018 | Family | H04R 3/12 |

* cited by examiner

SURROUND SOUND RENDERING BASED ON ROOM ACOUSTICS

FIELD

An aspect of the disclosure relates to performing audio processing techniques upon a sound program to render the sound program for output through one or more loudspeakers. Other aspects are also described.

BACKGROUND

Loudspeaker arrays may generate beam patterns to project sound in different directions. For example, a beamformer may receive input audio channels of a sound program (e.g., music) and convert the input audio channels to several driver signals that drive transducers (or drivers) of a loudspeaker array to produce one or more sound beam patterns.

SUMMARY

An aspect of the disclosure is a method performed by a programmed processor of an audio system within a room that includes a first loudspeaker that has a first loudspeaker beamforming array of two or more loudspeaker drivers and a second loudspeaker that has a second loudspeaker beamforming array of two or more loudspeaker drivers. The system obtains a sound program as several input audio channels. For example, the sound program may be a soundtrack of a movie that is in surround sound 5.1 format (e.g., having five input audio channels and one low-frequency channel). The system performs a beamforming algorithm based on the input audio channels to cause each of the first and second loudspeaker beamforming arrays to produce a front beam pattern and a side beam pattern when the loudspeakers are close to an object within the room (e.g., within a threshold distance). In this case, the front beam patterns are directed away from the object and the side beam patterns are directed towards the object. As a result, the different beam patterns may include different portions of the sound program. For instance, in the case of the sound track, the front beam pattern may include a center channel (that has dialogue), while the side beam pattern may include portions of the surround channels (left surround channel and right surround channel). The system, however, may perform a cross-talk cancellation (XTC) algorithm based on a subset of the input audio channels to produce several XTC output signals for driving at least some of the drivers of the loudspeakers when the loudspeakers are far away from the object (e.g., exceeding the threshold distance).

The above summary does not include an exhaustive list of all aspects of the disclosure. It is contemplated that the disclosure includes all systems and methods that can be practiced from all suitable combinations of the various aspects summarized above, as well as those disclosed in the Detailed Description below and particularly pointed out in the claims. Such combinations may have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect of this disclosure are not necessarily to the same aspect, and they mean at least one. Also, in the interest of conciseness and reducing the total number of figures, a given figure may be used to illustrate the features of more than one aspect, and not all elements in the figure may be required for a given aspect.

DETAILED DESCRIPTION

Several aspects of the disclosure with reference to the appended drawings are now explained. Whenever the shapes, relative positions and other aspects of the parts described in a given aspect are not explicitly defined, the scope of the disclosure here is not limited only to the parts shown, which are meant merely for the purpose of illustration. Also, while numerous details are set forth, it is understood that some aspects may be practiced without these details. In other instances, well-known circuits, structures, and techniques have not been shown in detail so as not to obscure the understanding of this description. Furthermore, unless the meaning is clearly to the contrary, all ranges set forth herein are deemed to be inclusive of each range's endpoints.

Figure 1:
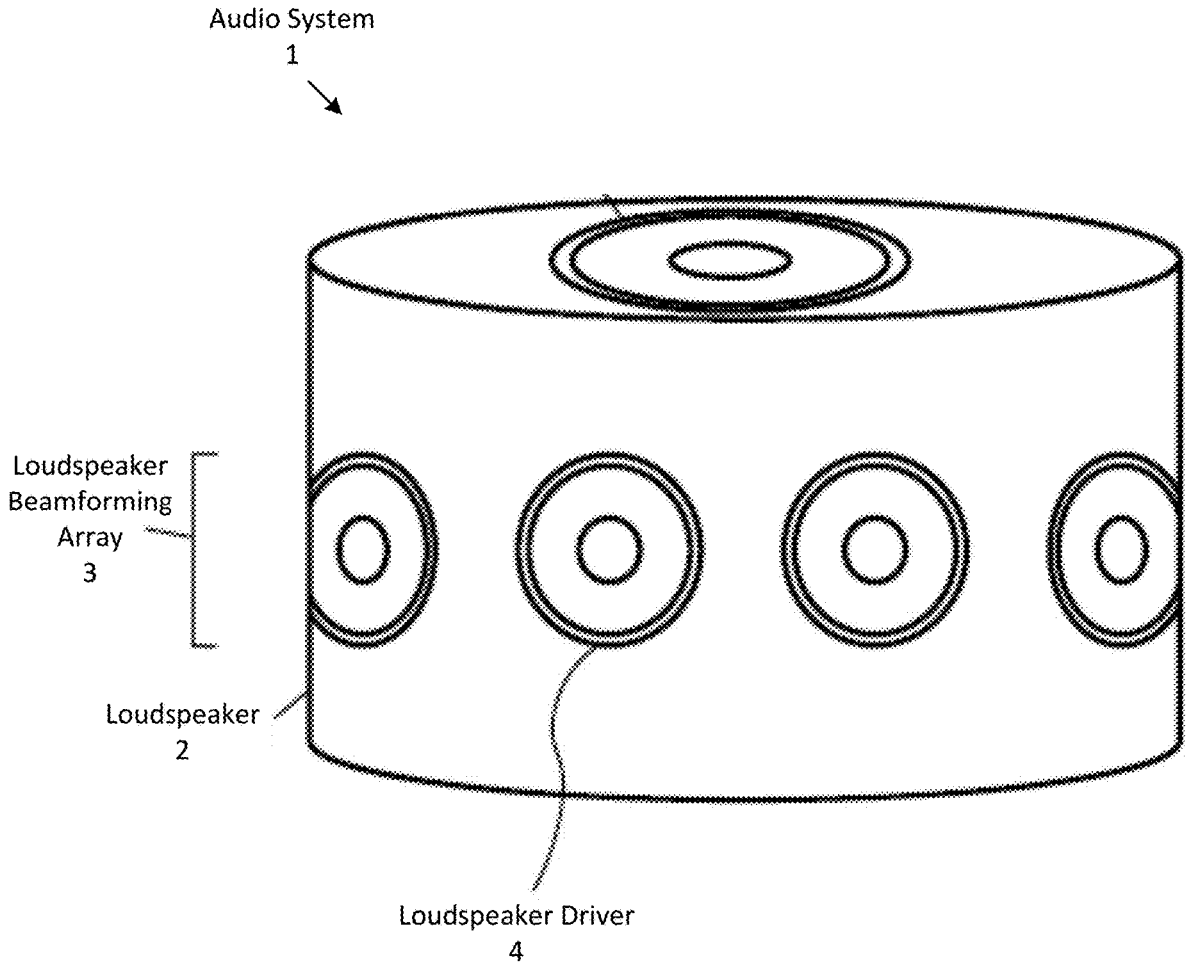
FIG. 1 shows an audio system that includes a loudspeaker with a loudspeaker array of two or more loudspeaker drivers.

FIG. 1 shows an audio (or loudspeaker) system 1 that includes a generally cylindrical shaped loudspeaker 2 that is configured to render and output a sound program as described herein. In one embodiment, the system may include one or more loudspeakers, each of which are configured to render and output at least a portion of the sound program. The loudspeaker 2 is a loudspeaker cabinet (or loudspeaker enclosure) that has a loudspeaker beamforming array 3 with individual loudspeaker drivers (or loudspeaker transducers) 4 that are arranged side-by-side and circumferentially around a center vertical axis of the loudspeaker 2. The loudspeaker 2 also includes a separate loudspeaker driver that is positioned at a top of the loudspeaker. In other aspects, however, the separate loudspeaker driver may be positioned at other locations (e.g., at a bottom of the loudspeaker). In one aspect, the loudspeaker may have other shapes, such as a donut shape, or a generally spherical or ellipsoid shape in which the drivers may be distributed evenly around essentially the entire surface of the ellipsoid.

The loudspeaker drivers 2 may be electrodynamic drivers, and may include some that are specifically designed for sound output at different frequency bands. For example, the top driver may be designed to operate better, more efficiently, at a low-range frequency band (e.g., this driver may be a woofer) than the other drivers. While at least some of the drivers that are positioned around the circumference of the loudspeaker may be designed to operate better, more efficiently, at a high-range frequency band (e.g., these drivers may be tweeters and midrange drivers) than the top driver. In one aspect, the drivers may be "full-range" (or "full-band") loudspeaker drivers that reproduce as much of an audible frequency range as possible.

Figure 2:
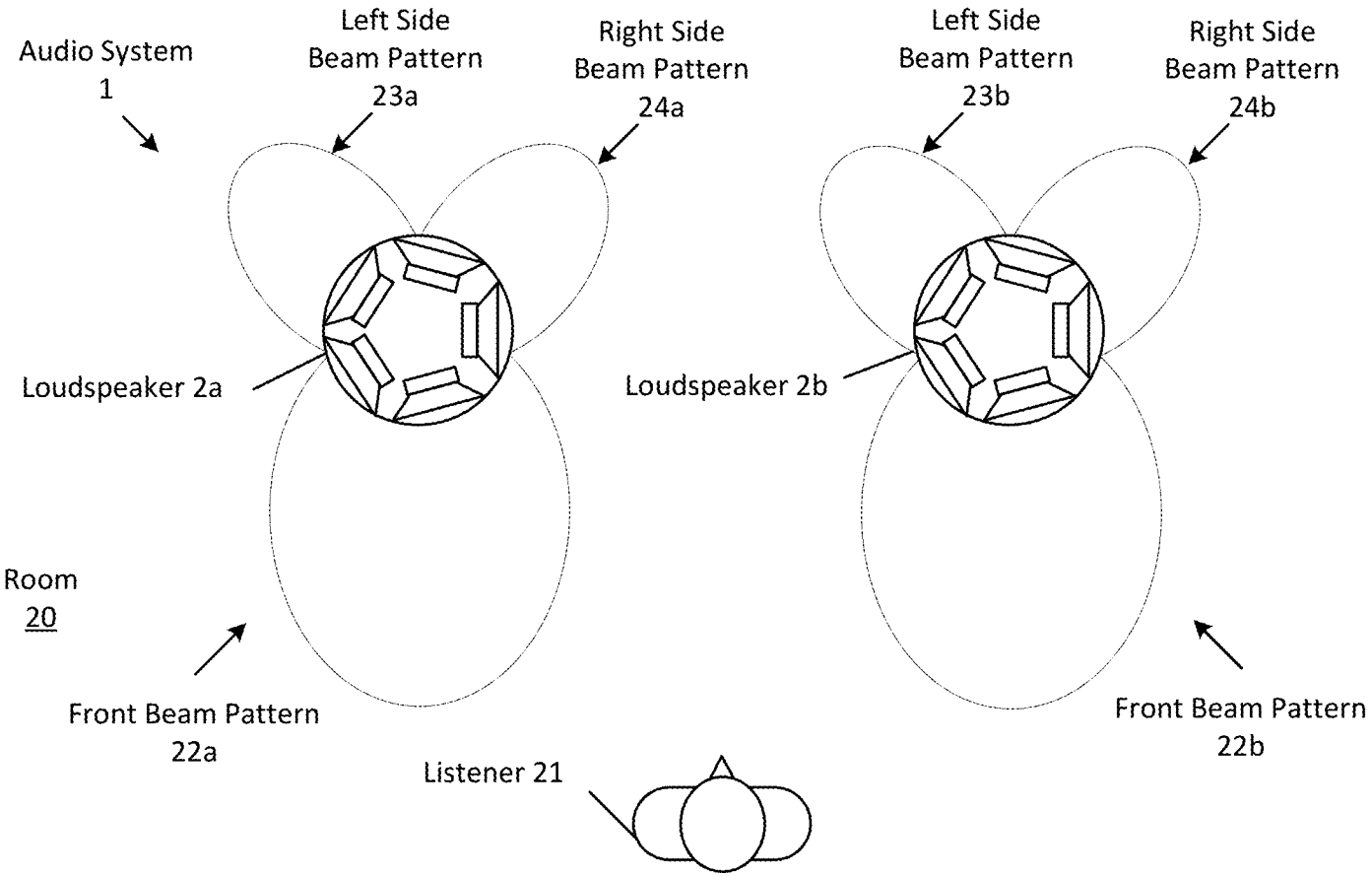
FIG. 2 shows a room with several loudspeakers configured to output sound according to one aspect.

FIG. 2 shows several loudspeakers that are configured to output sound according to one aspect. Specifically, this figure illustrates the audio system 1 having two loudspeakers 2*a* and 2*b* that are positioned in front of a listener 21 within a room 20. In one aspect, each of the loudspeakers may include the same components as one another (e.g., loudspeaker drivers, a one or more processors, each). In another aspect, the loudspeakers may be different electronic devices (e.g. loudspeaker 2*a* may be a loudspeaker cabinet as illustrated herein and loudspeaker 2*b* may be a different electronic device that is capable of rendering and outputting a sound program, such as a standalone speaker, a smartphone, or a laptop).

As illustrated, the loudspeakers 2*a* and 2*b* are outputting sound of a sound program. Specifically, each of the loudspeakers' is using its respective loudspeaker array to emit sound directional beam patterns that include at least some portions of a sound program (e.g., a musical composition, a movie soundtrack, a podcast, etc.). For instance, each of the loudspeakers includes a front beam pattern 22, and two side beam patterns, a left side beam pattern 23 and a right side beam pattern 24. In one aspect, each of the beam patterns may include portions of the sound program. For example, in the case of a movie soundtrack in which the sound program is in 5.1 surround sound format (e.g., a center channel, a left channel, a right channel, a left surround channel, a right surround channel, and a woofer channel), each of the beams may include at least one or more of the channels. In particular, the front beams 22*a* and 22*b* may include the center channel, the left side beam pattern 23*a* may include the left channel, and the right side beam pattern 24*b* may include the right channel. In one aspect, at least some of the beam patterns may include portions of the channels. For example, the left side beam pattern 23*a* and the right side beam pattern 24*a* may include portions of the left surround channel, while the left side beam pattern 23*b* and the right side beam pattern 24*b* may include a portion of the right surround channel.

In one aspect, the beam patterns may include other audio content. For example, the front beam patterns may include main audio content (e.g., correlated audio content), while at least some of the side beam patterns include ambient (or diffuse) audio content (e.g., decorrelated audio content).

In another aspect, the loudspeakers may produce other types of beam patterns. For example, the loudspeaker may produce an omnidirectional beam pattern that is superimposed with a directional beam pattern that has several lobes. In one aspect, the directional beam pattern may be a quadrupole beam having four lobes.

In one aspect, the loudspeakers are communicatively coupled to one another (and/or another electronic device) in order to output sound. For example, the loudspeakers may be wirelessly coupled or paired with one another, using e.g., BLUETOOTH protocol or any wireless protocol. For instance, each of the cabinets may communicate (e.g., using IEEE 802.11x standards) with each other by transmitting and receiving data packets (e.g., Internet Protocol (IP) packets). In one aspect, in order to communicate efficiently, each of the cabinets may communicate with each other over a peer-to-peer (P2P) distributed wireless computer network in a "master-slave" configuration. In particular, loudspeaker 2*a* may be configured as a "master", while loudspeaker 2*b* is a slave. Thus, when outputting the sound program loudspeaker 2*a* may transmit at least a portion of the sound program to the loudspeaker 2*b* for rendering and output. In one aspect, along with transmitting the sound program, the loudspeaker 2*a* may perform at least some audio processing operations, as described herein. While in some aspects the majority of the audio signal processing may be performed by another device that is paired with the loudspeakers. In another aspect, the loudspeakers may be wired to one another. In some aspects, both loudspeakers may perform (or divide) at least some of the operations between each other as described herein.

Multichannel sound systems may perform various audio processing techniques to improve listener experience. For instance, some systems may use widening techniques such as cross-talk cancellation (which involves eliminating an undesirable effect or sound from one or more channels) to produce sound sources that appear to be wider than the physical speaker setup. Systems may also use beamforming to project sound toward different locations in a sound space (or room). Both techniques, however, are typically static in configuration and predetermined by the manufacturer. As a result, this can lead to a sub-optimal listener experience depending upon the acoustics of the room in which the system is deployed.

To overcome these deficiencies, the present disclosure describes an audio system with one or more loudspeakers that performs different audio processing techniques based on the room acoustics and/or speaker placement within a room. Specifically, the audio system may perform different operations based on whether the loudspeakers of the audio system are close to an object. For example, the audio system performs a beamforming algorithm based on several input audio channels to direct at least one directional beam pattern (e.g., a front beam pattern, such as pattern 22*a*) away from the object and at least one directional beam pattern (e.g., a side beam pattern, such as pattern 23*a*) directed towards the object to generate sound reflections in the room in order to widen the spatial width of the sound field produced by the audio system. In contrast, when the loudspeakers are far away from the object, the audio system performs a XTC algorithm based on a subset of input audio channels to output XTC output signals in order to cancel or reduce some audio content at a particular point in the room.

Figure 3:
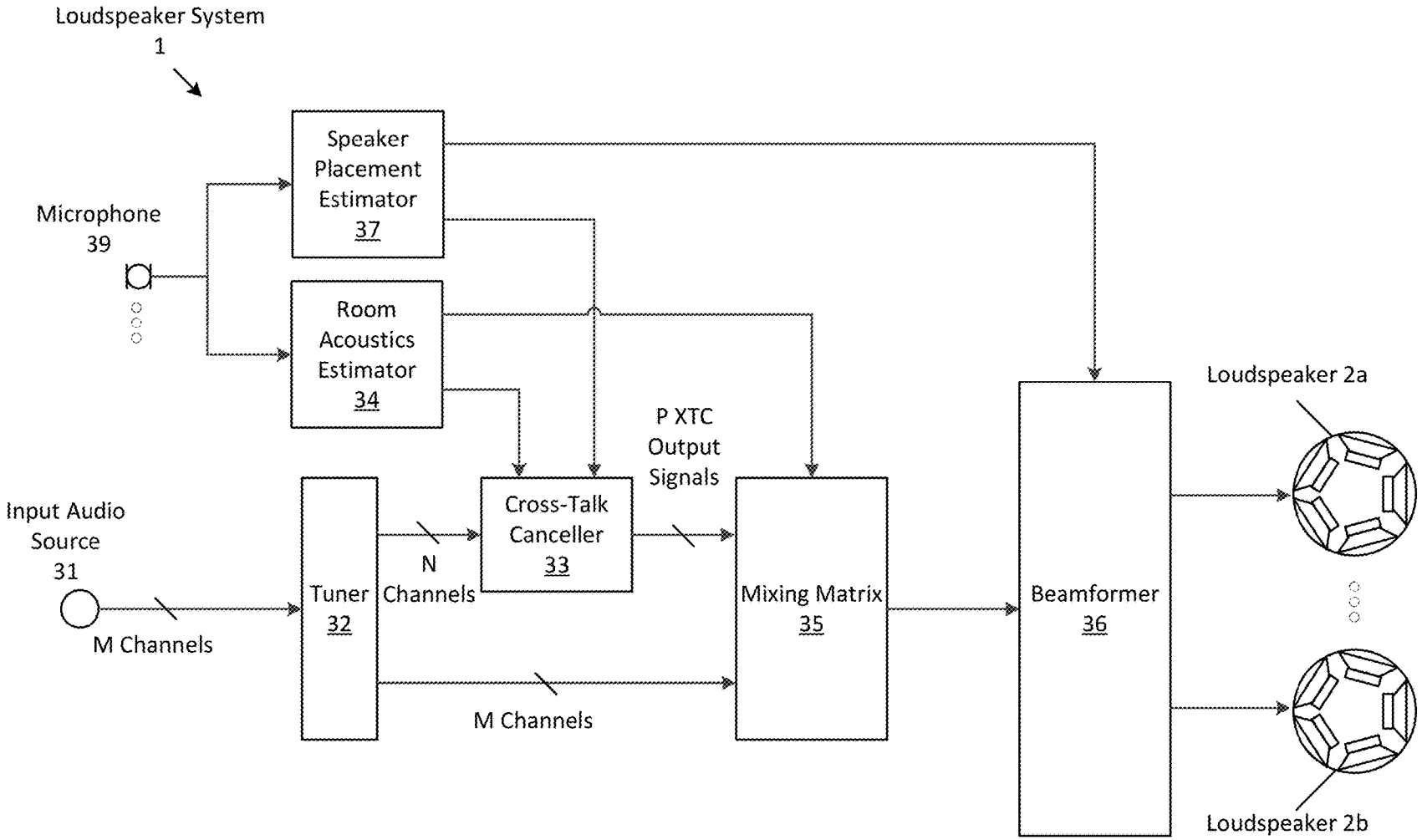
FIG. 3 shows a block diagram of an audio system that performs different audio processing techniques upon a sound program of one aspect of the disclosure.

FIG. 3 shows a block diagram of the audio system 1 that is configured to perform different audio processing techniques upon a sound program to render the sound program for output through one or more loudspeakers. Specifically, the system 1 includes loudspeakers 2*a* and 2*b*, an input audio source 31, at least one microphone 39, and several operational blocks. The microphone 39 may be any type of microphone (e.g., a differential pressure gradient micro-electro-mechanical system (MEMS) microphone) that will be used to convert acoustical energy caused by sound wave propagating in an acoustic space into an electrical microphone signal. In one aspect, the system may include more or less elements. For instance, the system may include two or more microphones or three or more loudspeakers. As another example, the system may only include one loudspeaker (e.g., loudspeaker 2*a* as illustrated in FIG. 2).

In one aspect, the input audio source 31 and/or the at least one microphone 39 may be a part of an electronic device, such as a smartphone or laptop computer. In one aspect, the source and/or microphones 39 may be a part of at least one of the loudspeakers. For example, loudspeaker 2*a* may include one or more microphones 39 integrated therein. As another example, the audio source 31 may be integrated within at least one of the loudspeakers.

The input audio source 31 is configured to provide a sound program (e.g., multichannel surround sound content in a surround sound format, such as 5.1, 5.1.2, 7.1, 7.1.4 input audio channels, etc.) to the audio system 1. In one aspect, the source may be any device that is capable of providing (or streaming) one or more input audio channels to the system. To provide the channels, the source may retrieve them locally (e.g., from an internal or external hard drive; or from an audio playback device, such as a compact disc player) or remotely (e.g., over the Internet). Once retrieved, the source may provide the channels as analog or digital signals to the audio system via a communication link (e.g., wireless or wired).

In one aspect, as described herein, functions, such as (digital) audio signal processing operations performed by the operational blocks may be performed by circuit components (or elements) within the audio system 1. For example, at least some of the operations may be performed by circuit components of one of the loudspeakers (e.g., loudspeaker 2*a*). In another aspect, at least some of these functions may be performed by electronic components outside of the loudspeakers, such as an audio receiver, a multimedia device (e.g., a smartphone) that is communicatively coupled to each of the loudspeakers. Thus, in this case, the loudspeakers may communicate, via either wired or wireless means, with the electronic components. In this example, however, a portion or all of the electronic hardware components, usually found within an audio receiver (e.g., a controller that includes one or more processors for performing audio processing operations) and the loudspeaker 2 may be in one enclosure. In one aspect, the audio system 1 may be a part of a home audio system or may be part of an audio or infotainment system integrated within a vehicle. In another embodiment, the loudspeaker may be a part of any electronic device that is capable rendering and outputting sound, such as a smartphone, a tablet computer, a laptop, or a desktop computer.

The audio system 1 includes a tuner 32, a cross-talk canceller 33, a speaker placement estimator 37, a room acoustics estimator 34, a mixing matrix 35, and a beamformer 36. The speaker placement estimator 37 is configured to estimate the position and/or configuration of at least one of the loudspeakers in the audio system. In one aspect, the estimator is configured to determine the number of loudspeakers within the audio system (e.g., loudspeakers that are to output sound contemporaneously). For example, the estimator may receive an indication from each loudspeaker that is paired with the audio system and/or with one another. As another example, the estimator may obtain user input (via a user interface) indicating the number of loudspeakers in the system.

In one aspect, the speaker placement estimator 37 may acoustically determine data that indicates the placement of the loudspeakers within the system, such as a distance between two or more loudspeakers. For instance, the estimator may obtain a microphone signal from at least one microphone 39 that includes sound produced by at least one other loudspeaker (e.g., loudspeaker 2*b*) of the audio system. The position of the microphone may be known (e.g., integrated within one of the loudspeakers, such as loudspeaker 2*a*). The estimator may use the microphone signal to measure an impulse response that estimates the distance between the loudspeaker 2*a* and loudspeaker 2*b*, for example.

In some aspects, the speaker placement estimator 37 may obtain the position of other loudspeakers through other methods. For example, the estimator may receive position data (e.g., GPS) from each of the loudspeakers of the audio system. As another example, when the loudspeakers are wirelessly coupled together, the position may be determined via wireless positioning, such as measuring the intensity of a received signal (e.g., Received Signal Strength ("RSS")).

In another aspect, the speaker placement estimator 37 is configured to acoustically determine whether at least one of the loudspeakers is close to an object, such as a bookcase or a wall of the room in which the loudspeakers are located, or whether the loudspeaker is far away from the object. Specifically, the speaker placement estimator may measure a room impulse response (RIR) at (at least) one loudspeaker (e.g., 2*a*), and use the measured RIR to determine whether the loudspeaker is close to an object within the room or far away from the object. For example, the loudspeaker 2*a* may cause one or more of the loudspeaker drivers 4 to output an audio signal (e.g., a test signal). The microphone 39, which may be integrated within loudspeaker 2*a* or whose position is known with respect to loudspeaker 2*a*, may produce a microphone signal that contains sound of the outputted audio signal and provide the signal to the estimator, which the estimator uses to measure the RIR. In one aspect, to determine whether the loudspeaker 2*a* is close or far away from the object, the estimator may compare the RIR to predefined RIRs. In another aspect, the estimator may determine closeness to an object based on whether the loudspeaker is within a threshold distance of the object. For instance, the measured RIR may indicate a distance from which the loudspeaker is from an object (e.g., based on reflections in the RIR). The estimator determines whether that distance is below a threshold (predefined) distance. In one aspect, the speaker placement estimator may perform these operations for each of the loudspeakers within the loudspeaker system. In one aspect, the estimator may estimate an average distance that each of the loudspeakers is from the object.

The room acoustics estimator 34 is configured to estimate acoustical properties (e.g., a reverberation level of the room, etc.) of the room in which the loudspeakers are located. Specifically, the estimator obtains a microphone signal from at least one microphone 39 and determines the acoustical properties based on the microphone signal. In one aspect, the estimator may determine the properties by measuring a RIR as described above.

In another aspect, the room acoustics estimator 34 is configured to determine a listener position (e.g., of listener 21) within the room (e.g., room 20). For instance, the estimator may determine the listener position with respect to at least one of the loudspeakers 2*a* and 2*b*. Specifically, the system 1 may determine the position based on direction of arrival (DOA) of a sound of the listener's voice. Specifically, the estimator may obtain one or more microphone signals from one or more microphones 39 that contain speech of the listener and determine the DOA based on delays contained within the signals. In another aspect, the estimator may determine the listener position based on data from one or more electronic devices, such as wearable devices (e.g., a smart watch, smart glasses, etc.) that are being worn by the listener or a smartphone that is at the listener position. For instance, the estimator may obtain position data (e.g., GPS data) from at least one of these devices. In some aspects, the estimator may obtain user input that indicates the position of the listener. For example, the listener may provide the listener position to an electronic device via a user interface. In another aspect, the estimator may obtain video data from at least one camera (not shown) that performs image recognition to identify the listener contained within the data.

The tuner 32 is to receive (or obtain) a sound program as M input audio channels (or M channels), which may be one or more input audio channels. For instance, when the sound program is a stereoscopic recording, the tuner receives two input audio channels. As another example, the tuner may receive more than two input audio channels, such as six channels (e.g., for 5.1 surround format) of a soundtrack for a movie. In one aspect, the tuner 32 is configured to perform audio processing operations upon at least some of the received input audio channels. For example, the tuner may perform equalization operations, dynamic range compression (DRC) operations, etc. In one aspect, the tuner is configured to upmix the input audio channels. For instance, in the case of a stereoscopic recording, the tuner may upmix the sound program to any surround sound format. In one aspect, the tuner may pass through at least some of the M channels. Meaning, the tuner may pass through native audio channels without performing audio signal processing operations, such as DRC operations.

The cross-talk canceller 33 is configured to receive a subset (e.g., N channels) of the M channels and to perform a XTC algorithm based on the N channels to produce several P XTC output signals. For example, in the case of a surround sound format, such as 5.1.2, the canceller may obtain the five audio channels and not obtain the woofer channel "0.1", nor the height channels "0.2". In another aspect, the canceler may obtain the height channels. In one aspect, the canceller performs the algorithm by mixing and/or delaying at least some of the N channels. Specifically, the canceller may combine at least a portion of one channel (e.g., a right channel) with another channel (e.g., a left channel), along with a delay. In one aspect, the canceller may apply one or more XTC filters upon at least some of the N channels to perform XTC. In another aspect, the canceller may perform spatial filters, such has head-related transfer functions (HRTFs). In one aspect, the algorithm may perform predetermined XTC operations. In other words, at least some of the operations may be generic or predetermined in a controlled setting (e.g., a laboratory). For example, the XTC algorithm may apply predetermined HRTFs for a predetermined position that is generally optimized for a single listener/sweet spot in the room. As a result, the canceller produces P XTC output signals (or channels). In one aspect, a number of P XTC output signals may be the same or different than a number of N channels.

In one aspect, the canceller may adjust (or optimize) the XTC algorithm based on room acoustics data and/or speaker placement data. Specifically, the canceller 33 may adjust the XTC output signals based on a determination of the listener position. The canceller may obtain the listener position from the room acoustics estimator 34 and adjust the XTC output signals to account for the listener position. For example, the canceller 33 may adjust the delays that are applied to the N channels in order to optimally cancel undesired portions of the sound program from different locations within the room. As another example, the canceller may apply position-specific XTC filters (e.g., HRTFs) according to the listener position, rather than a generic one in order to optimize user experience. The canceller 33 may also optimize the XTC algorithm based on the speaker placement data obtained from the estimator 37. For instance, the canceller 33 may optimize (e.g., applied delays by) the XTC algorithm based on the number of loudspeakers in the audio system and/or based on a known distance between the loudspeakers in the system. As described herein, the optimization of the XTC algorithm may be performed at different time intervals (e.g., every minute) and/or may be performed based upon a determination of a change in listener (or loudspeaker) position. As a result, the system 1 may track listener position and in response optimize the algorithm.

The mixing matrix 35 is configured to performing mixing operations to mix at least some of the M channels with at least some of the P XTC output signals to produce mixed signals as inputs to the beamformer. In one aspect, the mixing matrix is configured to perform additional audio processing operations. For example, the mixing matrix may apply delays upon at least some of the M channels to account for the processing time of the XTC algorithm. In another aspect, the matrix may apply gains to one or more of the M channels (and/or XTC output signals) based upon room acoustics data. As will be described herein, the matrix may apply different gains to different channels based on the reverberation level of (portions of) the room. In one aspect, the matrix may not perform any mixing operations and rather pass through at least some of the M channels (and/or XTC output signals) directly to the beamformer 36.

The beamformer 36 is configured to obtain the signals from the mixing matrix and produce individual driver signals for at least one of the loudspeakers 2*a* and 2*b* so as to render audio content of the input audio signals of the sound program as one or more desired sound beam patterns emitted by the loudspeaker arrays of the loudspeakers. In one aspect, the signals obtained from the mixing matrix may indicate what audio content is to be rendered as specific beam patterns. In another aspect, the beam patterns produced by the loudspeaker arrays may be shaped and steered by the beamformer, according to beamformer weight vectors that are each applied to the beamformer input audio signals. In one aspect, beam patterns produced by the loudspeaker arrays may be tailored from input audio channels, in accordance with any one of a number of pre-configured beam patterns, such as a front beam pattern and one or more side beam patterns. In one aspect, the beamformer may adjust one or more beam patterns based on speaker placement data obtained from the speaker placement estimator 37. Such data (e.g., the distance between loudspeakers, the number of loudspeakers, and/or whether there is an object close to the loudspeakers) may inform the beamformer of beam width and/or the angle at which a beam is to be directed. As a result, the beamformer produces the individual driver signals, which are (wirelessly) transmitted to one or more of the loudspeakers 2*a* and 2*b*.

Figure 4:
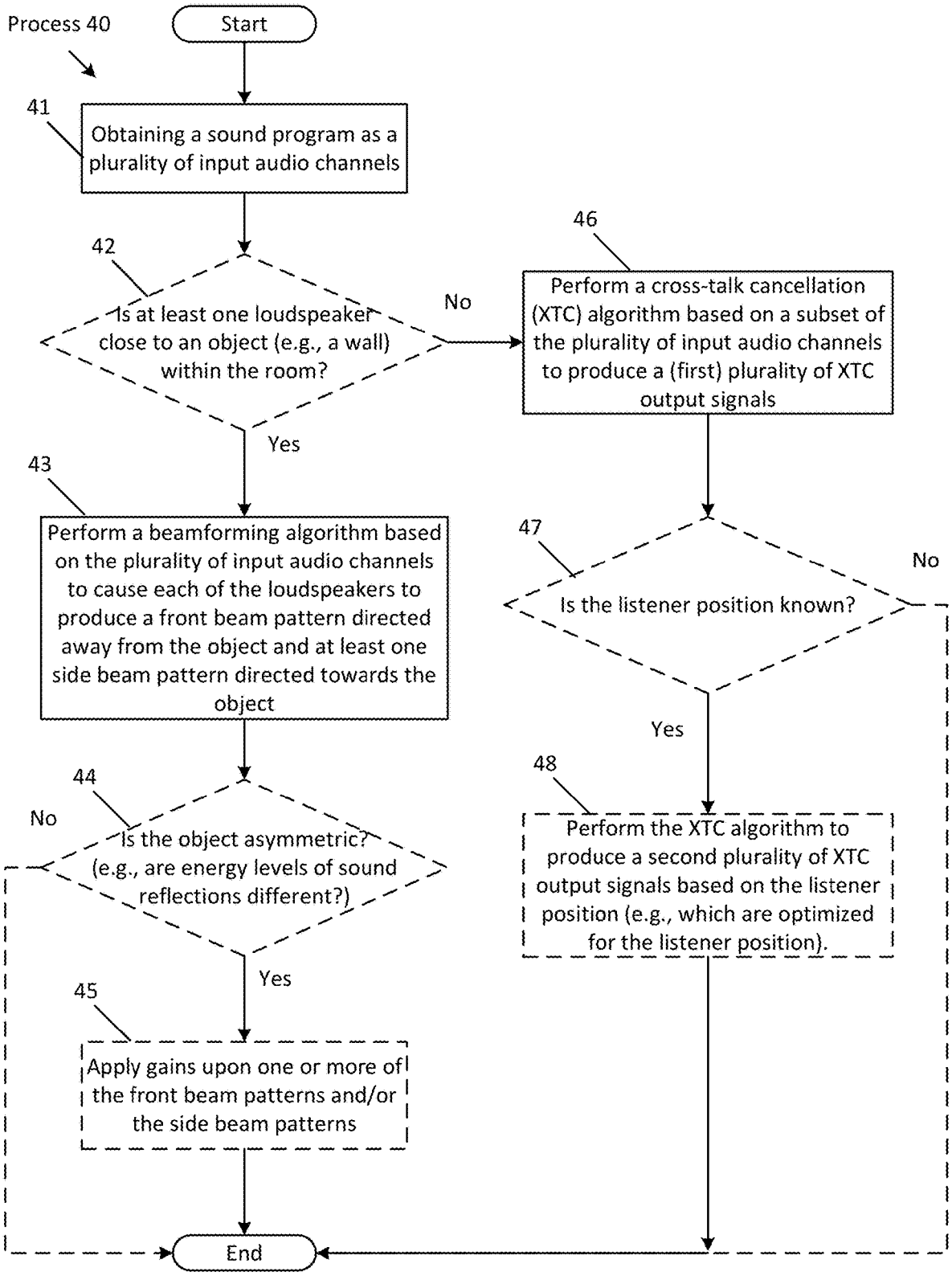
FIG. 4 is a flowchart of one aspect of a process to perform different audio processing techniques according to one aspect of the disclosure.

FIG. 4 is a flowchart of one aspect of a process 40 performed by the audio system 1 to perform different audio processing techniques according to one aspect of the disclosure. Specifically, the process 40 determines whether to perform XTC operations and/or beamforming operations based on whether there is an object, such as a wall that is close to at least one loudspeaker (e.g., 2*a* and/or 2*b*) of the audio system 1 described herein. In one aspect, the process 40 may be performed during an initial setup of the audio system (e.g., when a listener first activates the system). In another aspect, the process 40 may be performed periodically (e.g., once an hour, once a day). In another aspect, the process may be performed when at least one of the elements within the audio system (e.g., loudspeaker 2*a*) is moved from one position to another (e.g., indicated by a motion sensor, such as an accelerometer coupled to the loudspeaker). As yet another example, the process may be performed upon determining that the listener position has changed. For instance, as described herein, the system may track the listener position (e.g., based on DOA of the listener's voice). Upon determining that the listener position has changed (e.g., moved at least a threshold distance from a current position), the process 40 may be performed.

The process 40 begins by obtaining a sound program as two or more input audio channels (at block 41). As described herein, the sound program may include more than two input audio channels, such as a soundtrack of a movie that may include 5.1.2 surround format. The process 40 determines whether at least one loudspeaker is close to an object, such as a wall within the room in which the loudspeaker is located (at decision block 42). For example, referring to FIG. 2, the speaker placement estimator 37 may determine whether one (or both) of the loudspeakers is close to a wall based on a measured RIR.

If so, the process 40 performs a beamforming algorithm based on the M channels to cause each of the loudspeakers to produce a front beam pattern directed away from the object and at least one side beam pattern directed towards the object (at block 43). For example, referring to FIG. 2, when the loudspeakers 2*a* and 2*b* are close to a wall that is in front of the listener 21, both loudspeakers produce a respective front beam pattern 22 directed away from the wall and produce at least one side beam pattern (e.g., 23 and/or 24) towards the wall. In one aspect, the loudspeakers may direct the beam patterns towards predetermined directions. For example, the front beam pattern may be projected perpendicular to the object, while the side beams are directed towards the object at different angles with respect to the direction of the front beam pattern, as illustrated. To beamform, the audio system 1 may pass the M channels from the tuner 32 to the mixing matrix 35, without providing the XTC output signals to the mixing matrix. In other words, when the loudspeakers are determined to be close to the wall, the cross-talk canceller 33 may be deactivated. As a result, the mixing matrix may produce the one or more inputs for the beamformer based on the M channels, which are used by the beamformer 36 to produce the front and side beam patterns.

In one aspect, the beamformer may produce pre-configured beam patterns with predetermined properties (e.g., predefined beam angles, beam widths, delays, etc.). In another aspect, the beamformer may produce beam patterns that are configured according to the listener position. For instance, the properties of the beamformer may be configured to optimize the beam patterns for the listener position.

The process 40 determines whether the object is asymmetric (at decision block 44). Specifically, the room acoustics estimator 34 determines whether the object is asymmetric based on a sound energy level of sound reflections from the object. For example, when the audio system includes two loudspeakers 2*a* and 2*b* that are next to an object, such as a wall, the wall may be asymmetric when a microphone of one loudspeaker senses more sound reflections than a microphone of the other loudspeaker. Additional sound reflections may be caused when one of the loudspeakers is next to a corner of the wall, whereas less sound reflections may be sensed when a loudspeaker is next to a flat side of the wall. Thus, the room acoustics estimator may obtain, from at least one microphone of each loudspeaker, a microphone signal that contains sound reflections from the object to the loudspeaker. Using the microphone signals, the estimator 34 determines whether sound energies of the sound reflections are the same (or similar). If not, meaning that the object is determined to be asymmetric, the estimator may indicate the difference to the mixing matrix 35, which is configured to apply (e.g., different) gain values to one or more front beam patterns and/or one or more side beam patterns of the loudspeakers (at block 45). For example, if loudspeaker 2*a* were next to a corner of a wall, while loudspeaker 2*b* is next to a flat side of the wall, the mixing matrix may apply a first gain to at least one of the left side beam pattern 23*b* and the right side beam pattern 24*b* and apply a second gain to at least one of the left side beam pattern 23*a* and the right side beam pattern 24*b* that is less than the first gain. By applying different gains, the loudspeaker system may balance the sound energy of sound reflections from the object in order to provide a better balance of sound energy being experienced by the listener.

Returning to decision block 42, if the loudspeaker is not close to the object, the process 40 performs the XTC algorithm based on a subset of the total input audio channels to produce a (first) several XTC output signals for driving at least some of the drivers of the first and second beamforming arrays (at block 46). Specifically, returning to FIG. 3, when the speaker placement estimator 37 determines that one or more of the loudspeakers is far from the wall (e.g., exceeding the distance threshold), the cross-talk canceller 33 is activated and produces the P XTC output signals from the N channels as described herein. Once produced, the mixing matrix 35 may mix the P XTC output signals with at least some of the M channels. In one aspect, the beamformer obtains the mixed signals from the mixing matrix and produces one or more beam patterns. For example, the beamformer may emit front beam patterns (e.g., 22*a* and 22*b*). In another aspect, while performing the XTC algorithm the loudspeaker system does not produce side beam patterns, since the loudspeakers are not close to a wall. In another aspect, the mixing matrix 35 may direct the beamformer 36 to output at least some of the P XTC output signals through specific loudspeaker drivers of the loudspeaker array.

The process 40 determines whether the listener position is known (at decision block 47). Specifically, the room acoustics estimator 34 determines the listener position as described herein. If the position is known, the process 40 performs the XTC algorithm to produce a second (adjusted) XTC output signals based on the listener position, which are optimized for the listener position (at block 48). For example, the canceller 33 may adjust at least some of the delays that are applied to the N channels according to the listener position. In one aspect, the canceller may choose an appropriate spatial filter, such as a HRTF based on the location of the listener with respect to the loudspeakers.

Some aspects may perform variations to the processes described herein. For example, the specific operations of at least some of the processes may not be performed in the exact order shown and described. The specific operations may not be performed in one continuous series of operations and different specific operations may be performed in different aspects. For instance, at least some of the operations described herein are operational operations that may or may not be performed. Specifically, blocks that are illustrated as having dashed or dotted boundaries may optionally be performed. In another aspect, other operations described in relation to other blocks may be optional as well.

In some aspects, the audio system may perform both the XTC algorithm and the beamforming algorithm as described herein. For instance, the process 40 may omit the operations performed at block 42, and instead perform the operations of block 46 (and decision block 47 and/or block 48) and block 43 (and blocks 44 and 45). In one aspect, when performing both the XTC algorithm and beamforming algorithm the audio system may apply XTC to front beam patterns and/or side beam patterns that are emitted from each loudspeaker. This is in contrast to only performing the operations of 46 in which the XTC may be applied to just the front beam patterns and/or to specific loudspeaker drivers. In another aspect, different loudspeakers within the system may perform different algorithms. For example, when loudspeaker 2*a* is close to a wall the loudspeaker may perform the beamforming algorithm (e.g., by emitting a front beam pattern and a side beam pattern, while when loudspeaker 2*b* is far from the wall the loudspeaker may perform the XTC algorithm.

As described thus far, the operations of process 40 may be performed according to multiple loudspeakers (e.g., loudspeaker 2*a* and 2*b*). In one aspect, however, the operations described herein may be performed when the loudspeaker system 1 includes only one loudspeaker (e.g., loudspeaker 2). In this case, at least some of the operations described herein may be performed for only one loudspeaker. For instance, a determination of whether an object is asymmetric (at decision block 44) may be based on the directions towards which at least one side beam pattern produced by the loudspeaker is directed. For example, if the loudspeaker 2 were producing a left side beam pattern 23 that is directed towards the object in a first direction (e.g., with respect to the front beam pattern 22) and producing a right side beam pattern 24, the speaker placement estimator 37 may determine the sound energy of sound reflections along the first direction from the object and the sound energy of sound reflections along the second direction from the object. If the sound energies are not equal, such as there is more sound energy along the first direction, the audio system may apply more gain to the right side beam pattern than a gain that is to be applied to the left side beam pattern.

Personal information that is to be used should follow practices and privacy policies that are normally recognized as meeting (and/or exceeding) governmental and/or industry requirements to maintain privacy of users. For instance, any information should be managed so as to reduce risks of unauthorized or unintentional access or use, and the users should be informed clearly of the nature of any authorized use.

As previously explained, an aspect of the disclosure may be a non-transitory machine-readable medium (such as microelectronic memory) having stored thereon instructions, which program one or more data processing components (generically referred to here as a "processor") to perform the network operations, signal processing operations, and audio signal processing operations (e.g., beamforming operations, XTC operations, etc.). In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A signal processing method performed by a programmed processor of an audio system within a room that includes a first loudspeaker that has a first loudspeaker beamforming array of two or more loudspeaker drivers and a second loudspeaker that has a second loudspeaker beamforming array of two or more loudspeaker drivers, the method comprising:

obtaining a sound program as a plurality of input audio channels;

performing a beamforming algorithm based on the plurality of input audio channels to cause each of the first and second loudspeaker beamforming arrays to produce a front beam pattern and a side beam pattern when the loudspeakers are at a first distance away from an object, wherein the front beam patterns are directed away from the object and the side beam patterns are directed towards the object, wherein the side and front beam patterns contain different portions of the sound program; and performing a cross-talk cancellation (XTC) algorithm based on a subset of the plurality of input audio channels to produce a plurality of XTC output signals for driving at least some of the drivers of the first and second loudspeaker beamforming arrays when the loudspeakers are at a second distance away from the object, the second distance being further away form the object than the first distance.

2. The method of claim 1 further comprising measuring a room impulse response (RIR) at one of the first and second loudspeakers; and using the measured RIR to determine the first distance and/or the second distance from which the loudspeakers are from the object.

3. The method of claim 1, wherein each of the front beam patterns includes main audio content of the sound program and each of the side beam patterns includes ambient audio content of the sound program.

4. The method of claim 1 further comprising determining a listener position within the room with respect to the first and second loudspeakers.

5. The method of claim 4 further comprising, upon determining the listener position within the room, adjusting the plurality of XTC output signals to account for the listener position.

6. The method of claim 5, wherein driving the at least some of the drivers of the first and second loudspeaker beamforming arrays comprises performing the beamforming algorithm based on the adjusted plurality of XTC output signals and the plurality of input audio channels to cause each of the first and second loudspeaker beamforming arrays to produce front beam patterns.

7. The method of claim 1 further comprising:

obtaining, from a first microphone of the first loudspeaker, a first microphone signal that contains sound reflections from the object to the first loudspeaker;

obtaining, from a second microphone of the second loudspeaker, a second microphone signal that contains sound reflections from the object to the second loudspeaker;

using the first microphone signal to determine a first sound energy of sound reflections contained therein and using the second microphone signal to determine a second sound energy of sound reflections contained therein; and applying a first gain to the side beam pattern produced by the first loudspeaker based on the first sound energy and a second gain to the side beam pattern produced by the second loudspeaker.

8. An audio system comprising:

a first loudspeaker that has a first beamforming array of two or more drivers;

a second loudspeaker that has a second beamforming array of two or more drivers, wherein both loudspeakers are located within a room;

a processor; and memory having instructions stored therein which when executed causes the audio system to obtain a sound program as a plurality of input audio channels;

perform a beamforming algorithm based on the plurality of input audio channels to cause each of the first and second beamforming arrays to produce a front beam pattern and a side beam pattern when the loudspeakers are at a first distance away from an object, wherein the front beam patterns are directed away from the object and the side beam patterns that is directed towards the object, wherein the side and front beam patterns contain different portions of the sound program; and perform a cross-talk cancellation (XTC) algorithm based on a subset of the plurality of input audio channels to produce a plurality of XTC output signals for driving at least some of the drivers of the first and second beamforming arrays when the loudspeakers are at a second distance away from the object, the second distance being further away from the object than the first distance.

9. The audio system of claim 8, wherein the memory has further instructions to measure a room impulse response (RIR) at one of the first and second loudspeakers; and use the measured RIR to determine the first distance and/or the second distance from which the loudspeakers are from the object.

10. The audio system of claim 8, wherein each of the front beam patterns includes main audio content of the sound program and each of the side beam patterns includes ambient audio content of the sound program.

11. The audio system of claim 8, wherein the memory has further instructions to determine a listener position within the room with respect to the first and second loudspeakers.

12. The audio system of claim 11, wherein the memory has further instructions to, upon determining the listener position within the room, adjust the plurality of XTC output signals to account for the listener position.

13. The audio system of claim 12, wherein the instructions to drive the at least some of the drivers of the first and second beamforming arrays comprises performing the beamforming algorithm based on the adjusted plurality of XTC output signals and the plurality of delayed input audio channels to cause each of the first and second beamforming arrays to produce front beam patterns.

14. The audio system of claim 8, wherein the memory has further instructions to obtain, from a first microphone of the first loudspeaker, a first microphone signal that contains sound reflections from the object to the first loudspeaker;

obtain, from a second microphone of the second loudspeaker, a second microphone signal that contains sound reflections from the object to the second loudspeaker;

use the first microphone signal to determine a first sound energy of sound reflections contained therein and using the second microphone signal to determine a second sound energy of sound reflections contained therein; and apply a first gain to the side beam pattern produced by the first loudspeaker based on the first sound energy and a second gain to the side beam pattern produced by the second loudspeaker.

15. A signal processing method performed by a programmed processor of an audio system within a room that includes a loudspeaker that has a beamforming array of two or more drivers, the method comprising:

obtaining three or more input audio channels of a sound program;

determining whether the loudspeaker is within a threshold distance of an object;

in response to determining that the loudspeaker is within the threshold distance, producing, using the beamforming array, a first directional beam pattern that is directed away from the object and a second directional beam pattern that is directed towards the object, wherein the first and second directional beam patterns contain different portions of the sound program; and in response to determining that the loudspeaker is not within the threshold distance, performing a cross-talk cancellation (XTC) algorithm based on a subset of the three or more input audio channels to produce a plurality of XTC output signals, and driving the two or more drivers of the beamforming array with the plurality of XTC output signals.

16. The method of claim 15, wherein determining whether the loudspeaker is within a threshold distance of the object comprises measuring a room impulse response (RIR) at the loudspeaker; and using the measured RIR to determine whether the loudspeaker is within the threshold distance of the object.

17. The method of claim 15, wherein the first directional beam pattern includes main audio content of the sound program and the second directional beam pattern includes ambient audio content of the sound program.

18. The method of claim 15 further comprising determining a listener position within the room with respect to the loudspeaker; and upon determining the listener position within the room, adjusting the plurality of XTC output signals to account for the listener position.

19. The method of claim 15 further comprising producing, using the beamforming array, a third directional beam pattern that is directed towards the object in a first direction, wherein the second directional beam pattern is directed towards the object at a second direction that is different than the first direction.

20. The method of claim 19 further comprising obtaining, from at least one microphone, a microphone signal that contains sound reflections from the object;

using the microphone signal to determine a first sound energy of sound reflections along the first direction and to determine a second sound energy of sound reflections along the second direction; and applying a first gain to the third directional beam pattern based on the first sound energy and a second gain to the second directional beam pattern based on the second sound energy that is different than the first gain.

* * * * *